US008781382B2

(12) United States Patent
Okamoto

(10) Patent No.: US 8,781,382 B2
(45) Date of Patent: Jul. 15, 2014

(54) FIXING UNIT AND IMAGE FORMING APPARATUS

(75) Inventor: Jun Okamoto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 162 days.

(21) Appl. No.: 13/422,784

(22) Filed: Mar. 16, 2012

(65) Prior Publication Data

US 2012/0237274 A1 Sep. 20, 2012

(30) Foreign Application Priority Data

Mar. 17, 2011 (JP) ..... 2011-059736

(51) Int. Cl.
*G03G 15/20* (2006.01)

(52) U.S. Cl.
USPC ..... 399/329; 399/330

(58) Field of Classification Search
USPC ..... 399/330
See application file for complete search history.

(56) References Cited

U.S. PATENT DOCUMENTS

| | | | | |
|---|---|---|---|---|
| 3,490,934 | A * | 1/1970 | Small et al. | 427/486 |
| 5,300,996 | A | 4/1994 | Yokoyama et al. | |
| 5,648,842 | A | 7/1997 | Sekine et al. | |
| 5,678,153 | A | 10/1997 | Okamoto et al. | |
| 5,679,462 | A | 10/1997 | Soga et al. | |
| 5,873,017 | A | 2/1999 | Soga et al. | |
| RE36,124 | E | 3/1999 | Yokoyama et al. | |
| 5,913,092 | A | 6/1999 | Bisaiji et al. | |
| 6,067,435 | A | 5/2000 | Soga et al. | |
| 6,125,257 | A | 9/2000 | Sekine et al. | |
| 7,437,111 | B2 | 10/2008 | Yamada et al. | |
| 7,702,271 | B2 | 4/2010 | Yamada et al. | |
| 8,023,850 | B2 | 9/2011 | Okamoto et al. | |
| 8,027,627 | B2 | 9/2011 | Okamoto et al. | |
| 8,112,022 | B2 | 2/2012 | Okamoto et al. | |
| 2007/0059017 | A1 * | 3/2007 | Omura | 399/88 |
| 2009/0274477 | A1 | 11/2009 | Okamoto et al. | |
| 2009/0274495 | A1 | 11/2009 | Okamoto et al. | |
| 2009/0274497 | A1 | 11/2009 | Okamoto et al. | |
| 2011/0129266 | A1 * | 6/2011 | Maruko et al. | 399/328 |
| 2012/0070205 | A1 * | 3/2012 | Watanabe et al. | 399/328 |

FOREIGN PATENT DOCUMENTS

| | | |
|---|---|---|
| JP | 2007-79142 | 3/2007 |
| JP | 2009-139674 | 6/2009 |

OTHER PUBLICATIONS

Azizi et al. "Silane crosslinking of polyethylene." eXpress Polymer Letters vol. 1, No. 6 (2007) pp. 378-384.*
U.S. Appl. No. 13/357,135, filed Jan. 24, 2012, Okamoto.

* cited by examiner

*Primary Examiner* — Walter L Lindsay, Jr.
*Assistant Examiner* — Philip Marcus T Fadul
(74) *Attorney, Agent, or Firm* — Oblon, Spivak, McClelland, Maier & Neustadt, L.L.P.

(57) ABSTRACT

A fixing unit includes a fixing rotatable body that is located at a side of a recording medium, the side carrying a not-fixed image, a pressing rotatable body that is located at another side of the recording medium and that is disposed so as to abut on the fixing rotatable body, a fixing heating unit that heats the fixing rotatable body, a first pressing heating unit that heats the pressing rotatable body from inside thereof, and a second pressing heating unit that is disposed opposite to a surface of the pressing rotatable body and that heats the pressing rotatable body from outside thereof.

10 Claims, 5 Drawing Sheets

FIXING UNIT AND IMAGE FORMING APPARATUS

CROSS-REFERENCE TO RELATED APPLICATIONS

The present application claims priority to and incorporates by reference the entire contents of Japanese Patent Application No. 2011-059736 filed in Japan on Mar. 17, 2011.

BACKGROUND OF THE INVENTION

1. Field of the Invention

The present invention generally relates to a fixing unit and an image forming apparatus provided with the same. Specifically, the present invention relates to the fixing unit for the image forming apparatus such as a copying machine, a facsimile, a printer or the like, the fixing unit including a fixing rotatable body such as a fixing belt, a pressing rotatable body such as a pressing roller arranged abutting against the fixing rotatable body, and heaters for heating these rotatable bodies.

2. Description of the Related Art

Conventionally there is known a fixing unit provided for an image forming apparatus such as a copying machine, a facsimile, a printer or the like. The fixing unit includes a fixing rotatable body such as a fixing belt, a pressing rotatable body such as a pressing roller arranged abutting against the fixing rotatable body, and a heater for heating these rotatable bodies. And, there is known an image forming apparatus provided with such a fixing unit (for example, see Japanese Patent Application Laid-open No. 2009-139674 and Japanese Patent Application Laid-open No. 2007-079142).

In such a fixing unit, in order to achieve high-quality fixing, it is extremely important to keep the fixing rotatable body at a certain temperature suitable for fixing while fixing is being carried out. However, in a state that the fixing rotatable body, the pressing rotatable body and the like are not sufficiently heated, especially for example immediately after the image forming apparatus is turned on, if a recording medium such as paper is passed through the nip between the fixing rotatable body and the pressing rotatable body in order to fix a toner image on the recording medium, the recording medium, a toner carried on the recording medium, and the pressing rotatable body which is not sufficiently heated may absorb heat from the fixing rotatable body to decrease a temperature of the fixing rotatable body. Thereby, if several to several tens of paper sheets are passed continuously, the temperature of the fixing rotatable body may fall below the lower limit of the fixing temperature to deteriorate the fixing quality. Especially, even in a case that the fixing is performed only for one recording medium when the recording medium carries color toners, the temperature of the fixing rotatable body may decrease from a time when a leading edge of the recording medium passes through the nip to a time when a trailing edge of the recording medium passes through the nip. As a result, a glossiness of the fixed image has difference between the leading edge and the trailing edge, so that the leading edge has the lowered glossiness.

Therefore, in order to prevent or suppress the temperature drop of the fixing rotatable body, there is proposed a technology for providing a supplementary heater for the fixing rotatable body (for example, see Japanese Patent Application Laid-open No. 2009-139674), and a technology for providing a supplementary heater for the pressing rotatable body (for example, see Japanese Patent Application Laid-open No. 2007-079142). The reason why a heater is provided for the pressing rotatable body to suppress the temperature drop of the fixing rotatable body is that the pressing rotatable body is one of the structures that deprive the fixing rotatable body of heat. In other words, the technology aims to increase the amount of heat applied to the pressing rotatable body in order to reduce the amount of heat that the pressing rotatable body deprives from the fixing rotatable body.

In recent years, however, a thickness of the fixing rotatable body, as well as a size of rollers or the like which support the rotatable body when the body is a belt, becomes thinner in order to stop or suspend the heating during the standby mode and start the heating to immediately rise the temperature of the fixing rotatable body when starting the image forming, for the purpose of shortening a warm-up time of the fixing unit, saving the energy, reducing a TEC (Typical Electricity Consumption) value, and so on. As a result, the heat capacity is reduced. Thereby, the pressing rotatable body easily absorbs the heat from the fixing rotatable body to decrease the temperature of the fixing rotatable body, especially during the warm-up time. Therefore, the fixing rotatable body provided with the auxiliary heating unit still has a problem of deteriorating the fixing property.

This problem occurs even when a supplementary heater is provided for the pressing rotatable body. This is because it takes time for the heat generated by the heater to reach the external surface from the internal surface of the pressing rotatable body since the conventional heater is arranged inside of the pressing rotatable body and the pressing rotatable body has a certain thickness. In other words, the temperature gradient is formed in the thickness direction from the inside to the outside of the pressing rotatable body, depending on the thickness of the pressing rotatable body, and the thermal responsiveness is limited even if the pressing rotatable body is heated by the heater.

In order to save the energy, some studies have been conducted on toner that can be fixed at lower temperature. This technology could contribute to maintain the fixing property while the temperature is low at the time of a system startup. However, in this example, since the toner is prescribed to have a lower softening temperature, a so-called "hot offset" phenomenon may occur when the toner collected and attached to a cleaning roller or the like reaches a "flow start temperature" higher than the softening temperature while in use. As a result, the toner may be adversely re-transferred onto a member contacted with the cleaning roller, so that an abnormal image is induced. Therefore, it is desirable to ensure the fixing property during the warm-up time by the configuration of the fixing unit itself.

SUMMARY OF THE INVENTION

It is an object of the present invention to at least partially solve the problems in the conventional technology.

A fixing unit includes a fixing rotatable body that is located at a side of a recording medium, the side carrying a not-fixed image, a pressing rotatable body that is located at another side of the recording medium and that is disposed so as to abut on the fixing rotatable body, a fixing heating unit that heats the fixing rotatable body, a first pressing heating unit that heats the pressing rotatable body from inside of the pressing rotatable body, and a second pressing heating unit that is disposed opposite to a surface of the pressing rotatable body and that heats the pressing rotatable body from outside of the pressing rotatable body.

An image forming apparatus includes the aforementioned fixing unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
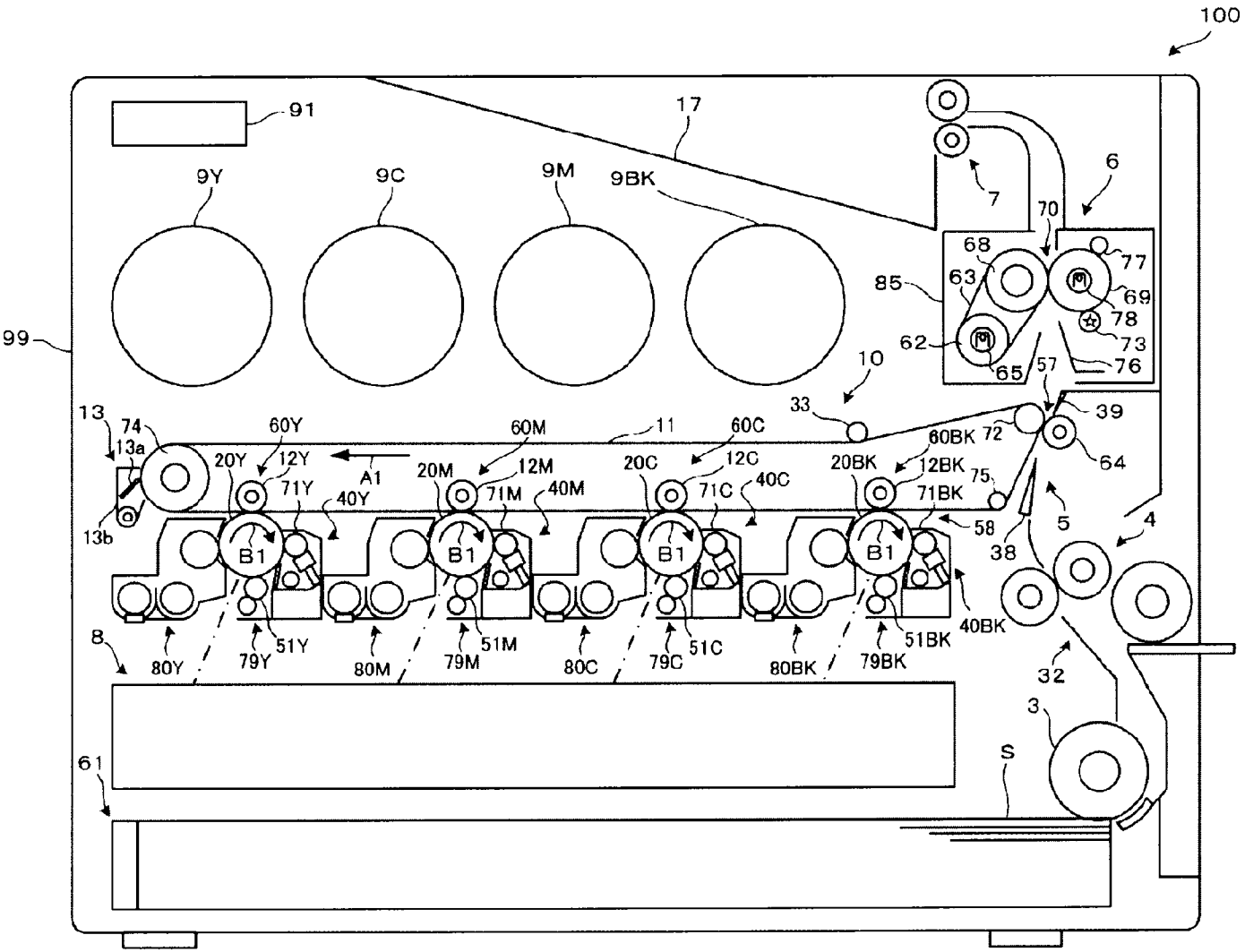
FIG. 1 is a general front view of an image forming apparatus to which an embodiment of the present invention is applied.

FIG. 1 illustrates a general view of an image forming apparatus to which an embodiment of the present invention is applied. An image forming apparatus 100 is a full-color laser printer, but may also be a different type of image forming apparatus, such as other types of printers, a facsimile, a copying machine, a printing machine, and a multifunctional peripheral (MFP) having functions of a copying machine and a printer. The image forming apparatus 100 performs an image forming process based on an image signal corresponding image information received from outside. The image forming apparatus 100 can perform image formation to any sheet-like recording medium, including an overhead projector (OHP) sheet, a thick paper sheet such as a card and a postcard, and an envelope, as well as a standard paper sheet generally used for copying and the like.

The image forming apparatus 100 has a tandem structure, that is, adopting a tandem arrangement including photosensitive drums 20Y, 20M, 20C, and 20BK as photosensitive elements that are latent image carriers being first image carriers on which images as imageries separated into corresponding to colors of yellow, magenta, cyan, and black can be respectively formed by carrying toners that are image forming materials, and that are arranged in parallel.

The photosensitive drums 20Y, 20M, 20C, and 20BK are arranged in parallel at an equal interval, sequentially from upstream in an A1 direction that is the counterclockwise direction in FIG. 1 and a moving direction of a transfer belt 11 that is an intermediate transfer belt being an endless belt that is an intermediate transfer body as a flexible second image carrier supported rotatably by a frame, not illustrated, included in a main unit 99 of the image forming apparatus 100. The letters Y, M, C, and BK appended to each of the reference numerals indicate members for colors of yellow, magenta, cyan, and black, respectively.

The photosensitive drums 20Y, 20M, 20C, and 20BK are included in image forming units 60Y, 60M, 60C, and 60BK that are imaging units for respectively forming images in the colors of yellow (Y), magenta (M), cyan (C), and black (BK).

The photosensitive drums 20Y, 20M, 20C, and 20BK are positioned facing the outer circumferential surface, that is, the imaging plane of the transfer belt 11 structured as an endless belt that is arranged almost at the center in the main unit 99.

The transfer belt 11 is movable in a manner facing the photosensitive drums 20Y, 20M, 20C, and 20BK in direction of the arrow A1. Visualized images that are toner images formed on the respective photosensitive drums 20Y, 20M, 20C, and 20BK are transferred onto the transfer belt 11 moving in the direction of the arrow A1, in a manner superimposed one after another, and further transferred in a set onto a transfer sheet S that is paper as a recording member being a recording medium. In this manner, the image forming apparatus 100 is an intermediate transfer type, that is, an indirect transfer type image forming apparatus. Therefore, the image forming apparatus 100 is a tandem and indirect type image forming apparatus.

The bottom part of the transfer belt 11 faces each of the photosensitive drums 20Y, 20M, 20C, and 20BK, and this facing part forms a primary transfer unit 58 where a toner image on each of the photosensitive drums 20Y, 20M, 20C, and 20BK is transferred onto the transfer belt 11.

The images are transferred onto the transfer belt 11 by applying a voltage to each of primary transfer rollers 12Y, 12M, 12C, and 12BK being a primary transfer unit arranged at a position facing the corresponding one of the photosensitive drums 20Y, 20M, 20C, and 20BK across the transfer belt 11 at operational timings that are offset from each other from upstream to downstream in the A1 direction in a process in which the transfer belt 11 moves in the A1 direction. In this manner, the toner images formed on the respective photosensitive drums 20Y, 20M, 20C, and 20BK are transferred onto the same position of the transfer belt 11 in a manner superimposed one after another.

The transfer belt 11 has a width of a horizontal A4-sized transfer sheet S in the width direction corresponding to a direction orthogonal to the figure plane of FIG. 1 and orthogonally intersecting the A1 direction. Therefore, the image forming apparatus 100 can perform image formation to a horizontal A3-sized transfer sheet S at the most.

The image forming apparatus 100 includes four of the image forming units 60Y, 60M, 60C, and 60BK installed in the main unit 99, a transfer belt unit 10 that is an intermediate transfer unit being a belt unit arranged above and facing the photosensitive drums 20Y, 20M, 20C, and 20BK and including the transfer belt 11, a secondary transfer unit 5 as a secondary transfer unit arranged on the right side of the transfer belt 11 in FIG. 1 and facing the transfer belt 11, and an optical scanning unit 8 that is an exposing unit as a writing unit that is an optical writing unit being a latent image forming unit arranged below and facing the image forming units 60Y, 60M, 60C, and 60BK.

In the main unit 99, the image forming apparatus 100 also includes a sheet feeding unit 61 as a paper feeding cassette that can store therein a plurality of transfer sheets S each of which is conveyed into a secondary transfer unit 57 that is a secondary transfer nip as a transfer nip being a transfer nip portion between the transfer belt 11 and the secondary transfer unit 5, a pair of registration rollers 4 that feed a recording sheet S fed from the sheet feeding unit 61 into the secondary transfer unit 57 at given operational timing synchronized with operational timing at which the toner images are formed by the image forming units 60Y, 60M, 60C, and 60BK, and a sensor, not illustrated, for detecting that the leading edge of the transfer sheet S reaches the pair of registration rollers 4.

In the main unit 99, the image forming apparatus 100 also includes a fixing unit 6 that is a thermal fixing unit being a belt-fixing type fixing unit that fixes a toner image that is an unfixed toner image onto a transfer sheet S having the toner image transferred by the secondary transfer unit 57, a paper feeding channel 32 having conveying rollers, not illustrated, for conveying the transfer sheet S fed by the sheet feeding unit 61 and where the pair of registration rollers 4 and the fixing unit 6 are disposed in the mid-course, discharging rollers 7 as a pair of discharging rollers that are discharging rollers arranged at the end of the paper feeding channel 32 and discharge the transfer sheet S after fixing is performed, that is, a medium having the image output to the outside of the main unit 99, toner bottles 9Y, 9M, 9C, and 9BK arranged above the transfer belt unit 10 and filled with respective toners in the colors of yellow, cyan, magenta, and black, and a discharge tray 17 as a discharging unit for stacking the transfer sheet S discharged by the discharging rollers 7 arranged in an upper portion of the main unit 99 to the outside of the main unit 99.

Figure 2:
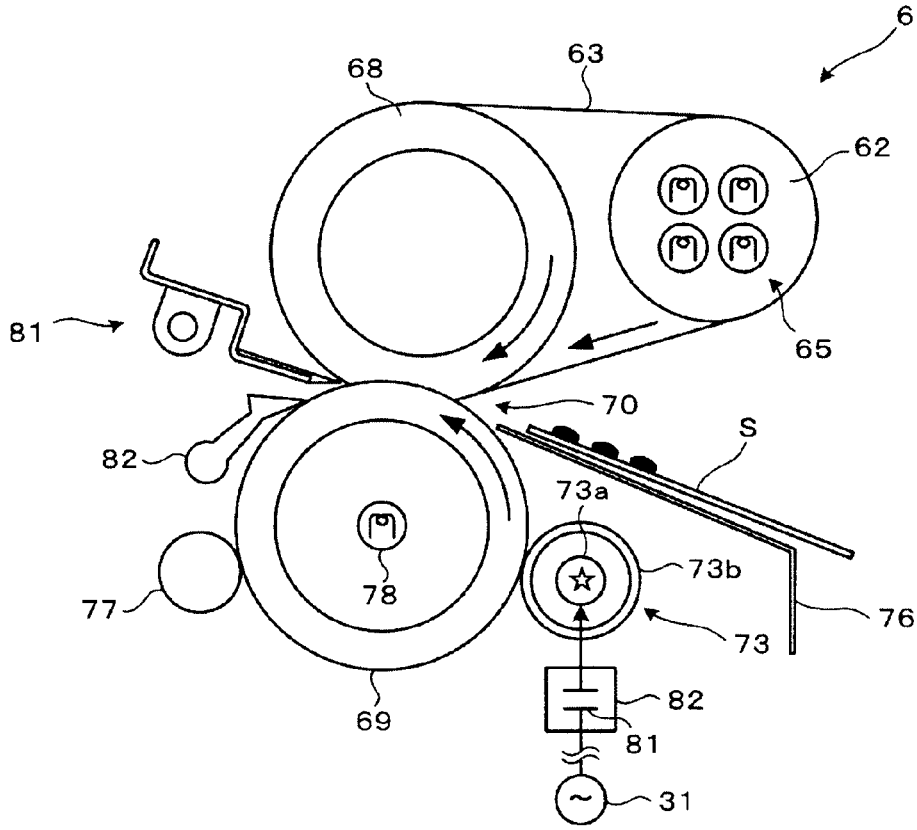
FIG. 2 is a general front view of a fixing unit included in the image forming apparatus illustrated in FIG. 1.

In the main unit 99, the image forming apparatus 100 also includes a driving apparatus including a driving motor and being a driving unit not illustrated for driving each of the photosensitive drums 20Y, 20M, 20C, and 20BK in rotation, a waste toner bottle not illustrated for storing waste toner resulting from image formation, a control unit 91 that controls the entire operations of the image forming apparatus 100 and includes a central processing unit (CPU), a memory, and the like, not illustrated, and a main power supply unit 31 illustrated in FIG. 2 and receiving a power supply from a commercial power source not illustrated.

In addition to the transfer belt 11, the transfer belt unit 10 includes the primary transfer rollers 12Y, 12M, 12C, and 12BK as primary transfer bias rollers, a driving roller 72 that is a driving member around which the transfer belt 11 is wound, a cleaning facing roller 74 as a stretching roller, stretching rollers 75 and 33 as supporting rollers for stretching the transfer belt 11 together with the driving roller 72 and the cleaning facing roller 74, and a cleaning unit 13 as a belt cleaning unit that is an intermediate transfer body cleaning unit that is arranged facing the transfer belt 11 and cleans the surface of the transfer belt 11.

The transfer belt unit 10 also includes a driving system, not illustrated, having a driving motor, not illustrated, for driving the driving roller 72 in rotation, a power source as a first transfer bias applying unit, not illustrated, for applying a primary transfer bias to each of the primary transfer rollers 12Y, 12M, 12C, and 12BK, and a first transfer bias controller realized as a function of the control unit 91.

The driving roller 72, the cleaning facing roller 74, and the stretching rollers 75 and 33 are supporting rollers across and around which the transfer belt 11 is stretched in a rotatably conveyable manner. The cleaning facing roller 74 and the stretching rollers 75 and 33 are following rollers that rotate in accordance with a rotation of the transfer belt 11 that is driven to rotate by the driving roller 72. Among the supporting rollers 72, 74, 75, and 33, only the stretching roller 33 abuts against the outer circumferential surface of the transfer belt 11, and the other supporting rollers 72, 74, and 75 abut against the rear surface, that is, the internal circumferential surface of the transfer belt 11.

Each of the primary transfer rollers 12Y, 12M, 12C, and 12BK is pressed against the photosensitive drums 20Y, 20M, 20C, and 20BK from the rear side of the transfer belt 11, thus forming a primary transfer nip as a transfer nip. The primary transfer nip is formed at a part of the transfer belt 11 stretched between the cleaning facing roller 74 and the stretching roller 75. The cleaning facing roller 74 and the stretching roller 75 have a function of stabilizing the primary transfer nip.

In each of the primary transfer nips, a primary transfer field is formed between each of the photosensitive drums 20Y, 20M, 20C, and 20BK and each of the primary transfer rollers 12Y, 12M, 12C, and 12BK by an effect of the primary transfer bias. The toner image in each of the colors formed on the corresponding one of the photosensitive drums 20Y, 20M, 20C, and 20BK is primarily transferred onto the transfer belt 11 by the effect of the corresponding primary transfer field and the nipping pressure that is a pressure applied to the transfer belt 11 by being nipped between the driving roller 72 and a secondary transfer roller 64.

The driving roller 72 abuts against the secondary transfer roller 64 across the transfer belt 11, and the transfer belt 11 is wound around the driving roller 72 at a position facing the secondary transfer roller 64, thus forming the secondary transfer unit 57. Therefore, the driving roller 72 also functions as a facing roller that is a secondary transfer facing roller.

The stretching roller 75 has a function as an entrance guiding member that allows the transfer sheet S to smoothly enter a wedge-shaped space that is formed between the transfer belt 11 and the secondary transfer roller 64 in the secondary transfer unit 57 and located on an upstream side in the A1 direction, and further to enter the secondary transfer unit 57.

The cleaning facing roller 74 has a function as a tension roller that is a pressing member for applying a predetermined tensile force suitable for transfer to the transfer belt 11.

The cleaning unit 13 is arranged on the left side of the cleaning facing roller 74 in FIG. 1. The cleaning unit 13 includes a cleaning blade 13*a* that is located at a position facing the cleaning facing roller 74, in other words, that is arranged abutting against the transfer belt 11 at a position downstream of the secondary transfer unit 57 and upstream of the primary transfer unit 58 in the A1 direction, and a case 13*b* for housing the cleaning blade 13*a*.

The cleaning unit 13 cleans the transfer belt 11 by scraping off and removing foreign substances such as waste toner from the transfer belt 11 using the cleaning blade 13*a*.

The transfer belt unit 10 can be attached to or removed from the main unit 99 integrally.

The sheet feeding unit 61 stores therein a bundle of transfer paper that is a stack of the transfer sheets S, and disposed in the lower part of the main unit 99.

The sheet feeding unit 61 includes a feeding roller 3 that is a paper feeding roller pressed against the top surface of the topmost transfer sheet S. The feeding roller 3 is driven in rotation in the counterclockwise direction at predetermined operational timing, to separate the topmost transfer sheet S one by one, and feeds the transfer sheet S into the pair of registration rollers 4. In other words, the paper feeding roller 3 also functions as a separating roller.

The transfer sheet S fed by the sheet feeding unit 61 is passed through the paper feeding channel 32, reaches the pair of registration rollers 4, and is nipped between the pair of registration rollers 4.

The secondary transfer unit 5 is arranged facing the driving roller 72. The secondary transfer unit 5 includes the secondary transfer roller 64 that is a rotatable body being a transfer roller as a transfer member that is a secondary transfer member arranged to nip the transfer belt 11 with the driving roller 72 so that the toner image on the transfer belt 11 can be transferred onto the transfer sheet S passed between the secondary transfer roller 64 and the transfer belt 11.

The secondary transfer unit 5 also includes a guide plate 38 as a paper guide that is disposed upstream of the secondary transfer unit 57 in the A1 direction, and guides the transfer sheet S being conveyed in a manner guiding the transfer sheet S fed by the pair of registration rollers 4 into the secondary transfer unit 57, and a separating plate 39 that is arranged downstream of the secondary transfer unit 57 in the A1 direction, separates the transfer sheet S having the toner image on the transfer belt 11 transferred in the secondary transfer unit 57 from the secondary transfer roller 64, and conveys the transfer sheet S into the fixing unit 6.

The secondary transfer roller 64 and a part of the transfer belt 11 near the secondary transfer unit 57 are arranged facing the paper feeding channel 32 so as to form the secondary transfer unit 57. The secondary transfer roller 64 functions as an abutting member that abuts against the transfer belt 11 to form the secondary transfer unit 57. In this manner, the area where the secondary transfer roller 64 and the transfer belt 11 face each other and abut against each other corresponds to the secondary transfer unit 57.

In the secondary transfer unit 57, the fixing unit 6 includes a fixing belt 63 that is a fixing rotatable body located on the side of a surface of the transfer sheet S having the toner image, that is, an unfixed image transferred from the transfer belt 11 and carrying the toner image, a fixing roller 68 and a heating roller 62 across which the fixing belt 63 is stretched, and a halogen heater 65 that is a heating heater as a fixing heater that is disposed inside of the heating roller 62 and that heats the fixing belt 63 by heating the heating roller 62.

The fixing unit 6 also includes a hollow pressing roller 69 as a pressing rotatable body that is arranged at a position facing the fixing roller 68 and in a manner pressed against the fixing belt 63, and is located on the side of the transfer sheet S opposite to the side carrying the toner image, a halogen heater 78 as a pressing heater being a first pressing heater that is arranged inside of the pressing roller 69 and heats the pressing roller 69 from inside, and a heater roller 73 that is a second pressing heater that is arranged facing and abutting against the surface of the pressing roller 69 and heats the pressing roller 69 from outside.

The fixing unit 6 also includes a heat pipe roller 77 that is a heat pipe arranged in a manner abutting against the surface of the pressing roller 69, and a guide plate 76 as a guiding member that guides the transfer sheet S having the toner image transferred from the transfer belt 11 in the secondary transfer unit 57 into a fixing nip 70 as a nip formed between the fixing belt 63 and the pressing roller 69 that abut against each other.

The fixing unit 6 also includes, as illustrated in FIG. 2, an auxiliary power supply unit 82 as an auxiliary power supply to which power is supplied from the main power supply unit 31 and including a capacitor 81 for supplying a power to the heater roller 73 at predetermined operational timing, which is to be explained later, so as to heat the pressing roller 69, a separating plate unit 81 that is arranged downstream of the fixing nip 70 in the rotating direction of the fixing belt 63 and separates the leading edge of the transfer sheet S passed through the fixing nip 70 from the fixing belt 63 so that transfer sheet S can be discharged from the fixing unit 6 into the discharging rollers 7, and a separating claw 82 as a pressing and separating unit that is arranged downstream of the fixing nip 70 in the rotating direction of the pressing roller 69 and separates the leading edge of the transfer sheet S passed through the fixing nip 70 from the pressing roller 69.

The fixing unit 6 also includes a fixing temperature detector and a pressing temperature detector not illustrated for respectively detecting the surface temperature of the fixing belt 63 and the surface temperature of the pressing roller 69, and a housing 85 illustrated in FIG. 1 and surrounding these structures.

The fixing belt 63 is an endless belt having a multi-layer structure including a base layer made of polyimide (PI) resin and having the thickness of 90 micrometers, an elastic layer sequentially stacked on the base layer and made of an elastic material, and a surface layer made of a releasing layer. The elastic layer of the fixing belt 63 has a thickness of approximately 200 micrometers and made of silicone rubber, but may be made of any other elastic material, such as fluororubber and foaming silicone rubber. The releasing layer of the fixing belt 63 has a thickness of approximately 20 micrometers, and is made of tetrafluoroethylene-perfluoroalkyl vinyl ether copolymer resin (PFA), but may be made of any material that can achieve a releasing property, that is, a separating property for toner, such as polyimide, polyetherimide, and polyether sulfide (PES).

The pressing roller 69 is a metallic pipe roller including a core metal, and a releasing layer made of PFA and coated on the surface of the core metal. The core metal included in the pressing roller 69 has a thickness of 0.5 millimeter, and is made of iron, but may be made of other materials such as aluminum. The thickness of the core metal may be set within the range of 0.2 millimeter to 1.0 millimeter. The material of the releasing layer is not limited to PFA.

The heat pipe roller 77 is arranged abutting against the pressing roller 69 downstream of the fixing nip 70 and upstream of a position where the heater roller 73 faces and abuts against the pressing roller 69 in the rotating direction of the pressing roller 69.

The heat pipe roller 77 is arranged to extend in a direction orthogonal to the figure plane of FIG. 2 that is the longitudinal direction of the pressing roller 69, that is, along the width direction of the fixing belt 63, and is structured to abut against the pressing roller 69 across the entire longitudinal surface of the pressing roller 69, and is rotated by the rotation of the pressing roller 69. In this manner, the heat pipe roller 77 functions as a temperature equalizing member that equalizes the temperature of the fixing belt 63 in the width direction by equalizing the temperature on the pressing roller 69 in the longitudinal direction, and also as a pressing cleaning member that cleans the pressing roller 69 by adsorbing the toner attached to the pressing roller 69.

Figure 3:
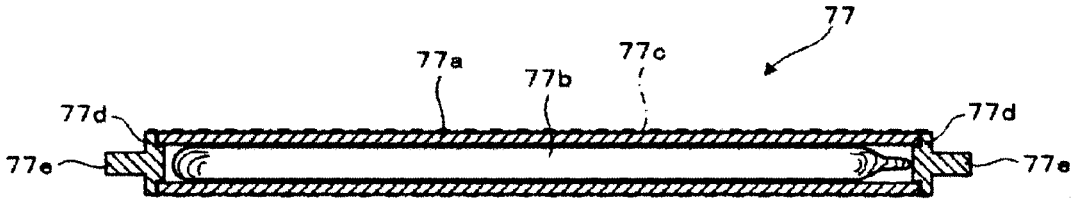
FIG. 3 is a general sectional view illustrating a heat pipe included in the fixing unit in FIG. 2 in detail.

The heat pipe roller 77 includes, as illustrated in FIG. 3, an element tube 77*a* made of aluminum, a heat pipe 77*b* made of copper and fitted in the element tube 77*a* by thermal tube expansion, a cross-linking agent 77*c* that is coated on the surface of the element tube 77*a*, and axes 77*e* formed by press-fitting axis members 77*d* made of a free cutting steel (SUM) or a special use stainless (SUS), for example, into the respective ends of the element tube 77*a*. The heat pipe roller 77 is rotatably supported on the housing 85 by the axes 77*e*. Used as a composition of the cross-linking agent 77*c* is iron salicylate having the effect of increasing the softening temperature of the toner by reacting with the toner transferred from the pressing roller 69, that is, offset toner. With the crosslinking agent 77*c*, the heat pipe roller 77 having a function of cleaning the pressing roller 69 can prevent or suppress the toner melting or "hot offset", further preventing or suppressing smears on the surface of the heater roller 73 located downstream in the rotating direction of the pressing roller 69, and contribute to achieving a high quality fixed image.

Figure 4:
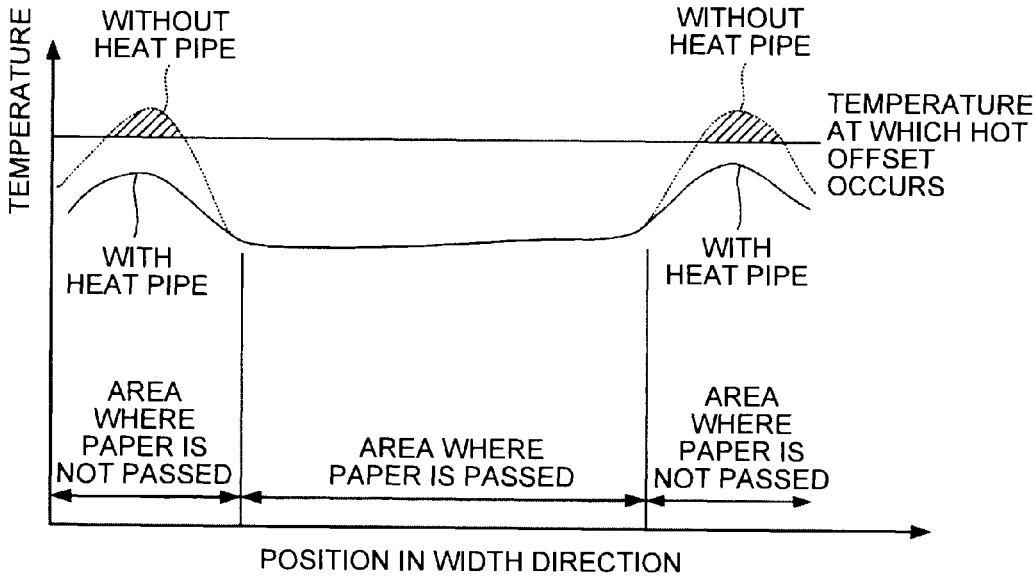
FIG. 4 is a graph illustrating an example of temperature profile of the fixing rotatable body observed in its width direction, including the temperature rise in areas where no paper enters, with and without a heat pipe.

Explained in detail with reference to FIG. 4 is how the heat pipe roller 77 functions as the temperature equalizing member that equalizes the temperature of the pressing roller 69 in the longitudinal direction. FIG. 4 illustrates how a temperature increase becomes different in the width direction of the fixing belt 63, that is, the direction orthogonally intersecting with the rotating direction of the fixing belt 63 becomes different with and without the heat pipe roller 77. Specifically, FIG. 4 compares, with and without the heat pipe roller 77, the temperature increase across the area passing the paper that is the area where the transfer sheet S abuts against the fixing belt 63 and the temperature increase in the areas not passing the paper in the width direction of the fixing belt 63, by passing small size transfer sheets S continuously through the fixing nip 70.

As illustrated in FIG. 4, when the transfer sheets S are passed continuously, the temperature in the central part of the fixing belt 63 where the sheets are passed remains constant. In an area where the sheets are not passed located at both edges of the fixing belt 63, the temperature of the fixing belt 63 overshoots higher when the heat pipe roller 77 is not used, as illustrated in the dotted line, and may reach a level where the "hot offset" occurs. On the contrary, when the heat pipe roller 77 is used, the temperature unevenness in longitudinal direction, that is, the axial direction of the pressing roller 69 is equalized, and, in turn, the temperature unevenness in the width direction of the fixing belt 63 is equalized. In this manner, the "hot offset" can be prevented.

In particular, because the heat pipe roller 77 abuts against the pressing roller 69 at a position downstream of the fixing nip 70 and upstream of the position where the heater roller 73 faces and abuts against the pressing roller 69 in the rotating direction of the pressing roller 69, the temperature unevenness on the pressing roller 69 can be remedied at an early stage, and the effect of equalizing the temperature unevenness on the fixing belt 63 can be achieved effectively.

The heater roller 73 includes a halogen heater 73*a* as a pressing auxiliary heater that is a heat source having its temperature raised by receiving a power supply from the capacitor 81, and a cylindrical portion 73*b* that is made of metal, is supported rotatably by the housing 85, internalizes the halogen heater 73*a*, and heats the pressing roller 69 by being heated and having its temperature raised by the halogen heater 73*a*. In the manner described above, the heater roller 73 has a roller-like structure, and is structured to be rotated by the rotation of the pressing roller 69. The surface of the cylindrical portion 73*b* may also have the function of cleaning the pressing roller 69, in the same manner as the heat pipe roller 77. The control unit 91 controls driving of the halogen heater 73*a*. In this manner, the control unit 91 functions as a supplementary heater controller.

The fixing unit 6 guides the transfer sheet S carrying the toner image to the fixing nip 70 with the guide plate 76, and passes the transfer sheet S nipped through the fixing nip 70. In this manner, by effects of the heat and the pressure, the toner image carried on the transfer sheet S is fixed to the surface of the transfer sheet S.

Other features of the fixing unit 6 will be described later.

The toners in colors of yellow, cyan, magenta, and black contained in the respective toner bottles 9Y, 9M, 9C, and 9BK are passed through conveying paths not illustrated, and supplied to respective developing units 80Y, 80M, 80C, and 80BK included in the respective image forming units 60Y, 60M, 60C, and 60BK, by a predetermined amount of supply.

All of the image forming units 60Y, 60M, 60C, and 60BK have the same structures. Around each of the photosensitive drums 20Y, 20M, 20C, and 20BK in the clockwise direction in FIG. 1, that is a rotating direction B1 of the photosensitive drums 20Y, 20M, 20C, and 20BK, each of the image forming units 60Y, 60M, 60C, and 60BK has corresponding one of the primary transfer roller 12Y, 12M, 12C, 12BK as an imaging unit, a cleaner 71Y, 71M, 71C, 71BK as a cleaning unit that is a cleaner, a neutralizer not illustrated that is a neutralizing unit, a charger 79Y, 79M, 79C, 79BK as a charging unit including a roller charger 51Y, 51M, 51C, 51BK for charging with an alternating current (AC) and forming a charging bias, and the developing unit 80Y, 80M, 80C, 80BK as a developing unit that performs a development using two component developer.

Each of the image forming units 60Y, 60M, 60C, and 60BK can be pulled out of the main unit 99 and pushed into the main unit 99 along guide rails not illustrated and fixed to the main unit 99, and is a process cartridge mounted on the main unit 99 in a removable manner. When each of the image forming units 60Y, 60M, 60C, and 60BK as a process cartridge is pushed into the main unit 99, each of the image forming units 60Y, 60M, 60C, and 60BK is loaded to and aligned to a predetermined position suited for image formation. By providing each of the image forming units 60Y, 60M, 60C, and 60BK a process cartridge, the image forming units 60Y, 60M, 60C, and 60BK can be handled as a replaceable part. In this manner, ease of maintenance is highly improved, and therefore, it is very preferable. Furthermore, because each elements of the process cartridge has an equal lifetime, unnecessary replacements can be prevented or suppressed, hence achieving a more preferable structure.

In the image forming apparatus 100 having such a structure, when a signal for forming a color image is input by a user, the control unit 91 stores and maintains an image formation job that is a print job containing image information corresponding to a full color image that is a desired image to be formed in a memory, drives the driving roller 72 to drive the transfer belt 11, and drives the cleaning facing roller 74, and the stretching rollers 75 and 33 in rotation, further to drive the photosensitive drums 20Y, 20M, 20C, and 20BK in rotation in the B1 direction.

With the rotation in the B1 direction, the surface of each of the photosensitive drums 20Y, 20M, 20C, and 20BK is charged to a given polarity uniformly by the charging bias generated by the corresponding one of the chargers 79Y, 79M, 79C, and 79BK. A latent image based on the image information is formed as an electrostatic latent image corresponding to each of the colors of yellow, magenta, cyan, and black on the surface of each of the photosensitive drums 20Y, 20M, 20C, and 20BK by being exposure-scanned, that is, being irradiated with an optically-modulated laser beam output from the optical scanning unit 8 and carried upwardly along a main-scanning direction generally matching the direction orthogonal to the figure plane of FIG. 2. The electrostatic latent image is then developed and visualized by the toner in each of the colors of yellow, magenta, cyan, and black using the developing bias in the developing unit 80Y, 80M, 80C, and 80BK and charged toners, and single color images that are toner images in one of the colors of magenta, cyan, and black are formed.

In order to form each electrostatic latent image corresponding to each color by driving the optical scanning unit 8, the control unit 91 decomposes the image information stored in the memory into each color image information for yellow, magenta, cyan, and black, and then drives the optical scanning unit 8 on the basis of the each color image information that is a single color image information decomposed from the image information.

The toner image in each of the colors of yellow, magenta, cyan, and black obtained by development is primarily transferred onto the same position on the transfer belt 11 rotating in the A1 direction, by the primary transfer bias generated by the primary transfer rollers 12Y, 12M, 12C, and 12BK, in the order of a yellow toner image, a magenta toner image, a cyan toner image, and a black toner image, sequentially from the one located on the most upstream side in the A1 direction, in the manner superimposing the colors. In this manner, a synthesized color image that is a full-color toner image is formed on the transfer belt 11 and carried by the transfer belt 11.

On the other hand, when a signal to form a color image is input, the feeding roller 3 included in the sheet feeding unit 61 rotates to take out and to separate the transfer sheet S one by one, and feeds the paper into the paper feeding channel 32. The transfer sheet S fed into the paper feeding channel 32 is further conveyed by conveying rollers not illustrated, and is stopped by abutting against the pair of registration rollers 4.

In synchronization with the operational timing at which the synthesized color image that is the superimposed image on the transfer belt 11 arrives at the secondary transfer unit 57 in accordance with the rotation of the transfer belt 11 in the A1 direction, in other words, at the operational timing of paper feeding, the pair of registration rollers 4 are rotated. In the secondary transfer unit 57, the synthesized color image carried on the transfer belt 11 adheres to the transfer sheet S fed into the secondary transfer unit 57, and is secondarily transferred altogether and recorded to the transfer sheet S that is the other medium by the effects of the secondary transfer bias and the nipping pressure.

The transfer sheet S is then conveyed and fed into the fixing unit 6 by the secondary transfer unit 5. When the transfer sheet S is passed through the fixing nip 70 that is the fixing unit between the fixing belt 63 and the pressing roller 69 in the fixing unit 6, the carried toner image, in other words, the synthesized color image is fixed by the effects of the heat and the pressure.

The transfer sheet S passed through the fixing unit 6 and having the synthesized color image fixed is passed through discharging rollers 7, discharged from the main unit 99, and stacked on the discharge tray 17 located at the top of the main unit 99.

The transfer residual toner that is waste toner remaining on each of the photosensitive drums 20Y, 20M, 20C, and 20BK after transfer and no longer necessary is wiped and removed from the surface of each the photosensitive drums 20Y, 20M, 20C, and 20BK by the corresponding cleaner 71Y, 71M, 71C, 71BK, neutralized by the corresponding neutralizer to have the surface potential initialized. Each of the photosensitive drums 20Y, 20M, 20C, and 20BK is then prepared to be charged again by each of the chargers 79Y, 79M, 79C, and 79BK. The transfer residual toner removed from the surfaces of the photosensitive drums 20Y, 20M, 20C, and 20BK by the respective cleaners 71Y, 71M, 71C, and 71BK is stored in a waste toner bottle.

The cleaning blade 13*a* included in the cleaning unit 13 then wipes and removes the transfer residual toner that is the toner remaining on the surface of the transfer belt 11 passed through the secondary transfer unit 57 after the secondary transfer is completed and no longer required, and the transfer belt 11 is prepared for the next transfer. The transfer residual toner removed from the surface of the transfer belt 11 by the cleaning unit 13 is stored in the waste toner bottle.

In order to achieve high quality fixing when such image formation is performed, it is extremely important for the fixing unit 6 to keep the temperature of the fixing belt 63 to temperature that is suitable for fixing while the fixing operation is performed. Therefore, in the fixing temperature 6, driving of the halogen heater 65 and the halogen heater 78 is controlled on the basis of the temperature of the fixing belt 63 and the temperature of the pressing roller 69, respectively measured by the fixing temperature detector and the pressing temperature detector. This control is performed by the control unit 91. The reason why the temperature of the pressing roller 69 is controlled to keep the temperature of the fixing belt 63 to an optimal temperature is because, if the temperature of the pressing roller 69 is low, the pressing roller 69 deprives the fixing belt 63 in the fixing nip 70 of heat, and the temperature of the fixing belt 63 is reduced. In this manner, the temperature of the fixing belt 63 is prevented from being reduced to a level lower than the optimal temperature.

Figure 5:
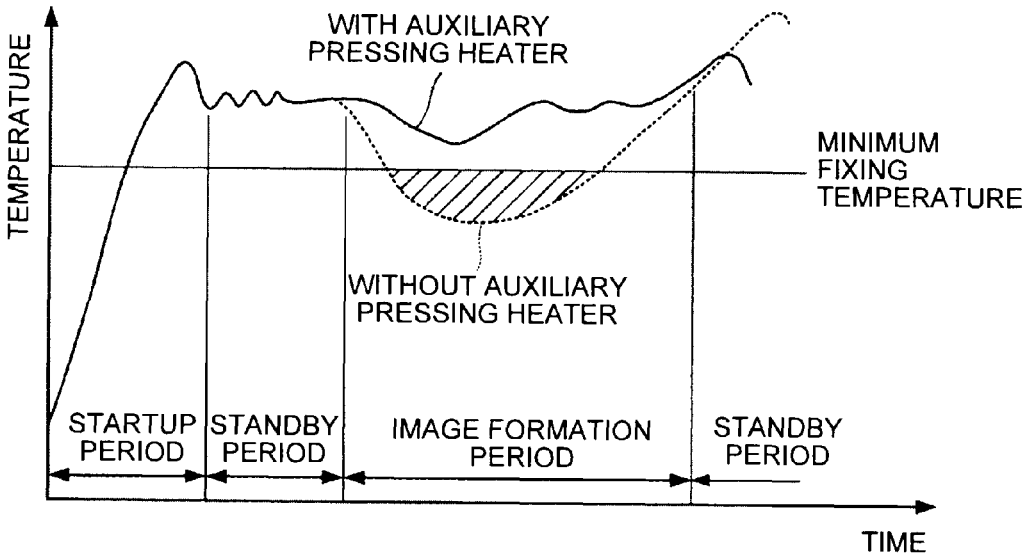
FIG. 5 is a graph illustrating an example of time-temperature profile of the fixing rotatable body with and without a pressing auxiliary heater.

However, as mentioned earlier, if the transfer sheet S is passed through the fixing nip 70 to have an image fixed while the fixing belt 63, the pressing roller 69, and the like are not sufficiently heated, e.g., immediately after the fixing unit 6 is started, the heat of the fixing belt 63 is absorbed by the pressing roller 69 and the like not sufficiently heated, and the temperature of the fixing belt 63 is reduced in the manner illustrated in a dotted line in FIG. 5. If several to several tens of transfer sheets S are then continuously passed, the temperature of the fixing belt 63 may be reduced to a level below the minimum fixing temperature (the lower limit of the fixing temperature), and the fixing quality or fixing property may deteriorate. In particular, when a color image is being formed, even by performing a fixing operation to a single sheet of transfer sheet S, the temperature of the fixing belt 63 may be reduced during the period while the leading edge through the trailing edge of the transfer sheet S is passed through the fixing nip 70. This may result in a large difference in the luster of the fixed image on the leading edge portion and the trailing edge portion, and a low luster or gloss image on the trailing edge.

These problems may be difficult to be solved completely by using an internal heater such as the halogen heater 78 to heat the pressing roller 69 from the inside. This is because the pressing roller 69 has usually a certain diameter to ensure certain strength for forming the fixing nip 70. Thereby, due to a heat capacity with the thickness (diameter) of the roller, a time lag is caused to raise the roller surface even if the roller is heated from the inside. Thus, the thermal responsiveness is limited.

Therefore, in the fixing unit 6, the pressing roller 69 is heated from the surface side using the heater roller 73, more specifically, using the halogen heater 73*a*. In this manner, the pressing roller 69 is prevented or suppressed from reducing the temperature of the fixing belt 63 even when image formation, that is, while the fixing is performed immediately after the fixing unit 6 is started, and the fixing belt 63 is kept at the optimal temperature even during the fixing operation immediately after the system startup, as illustrated in the solid line in FIG. 5.

Figure 6:
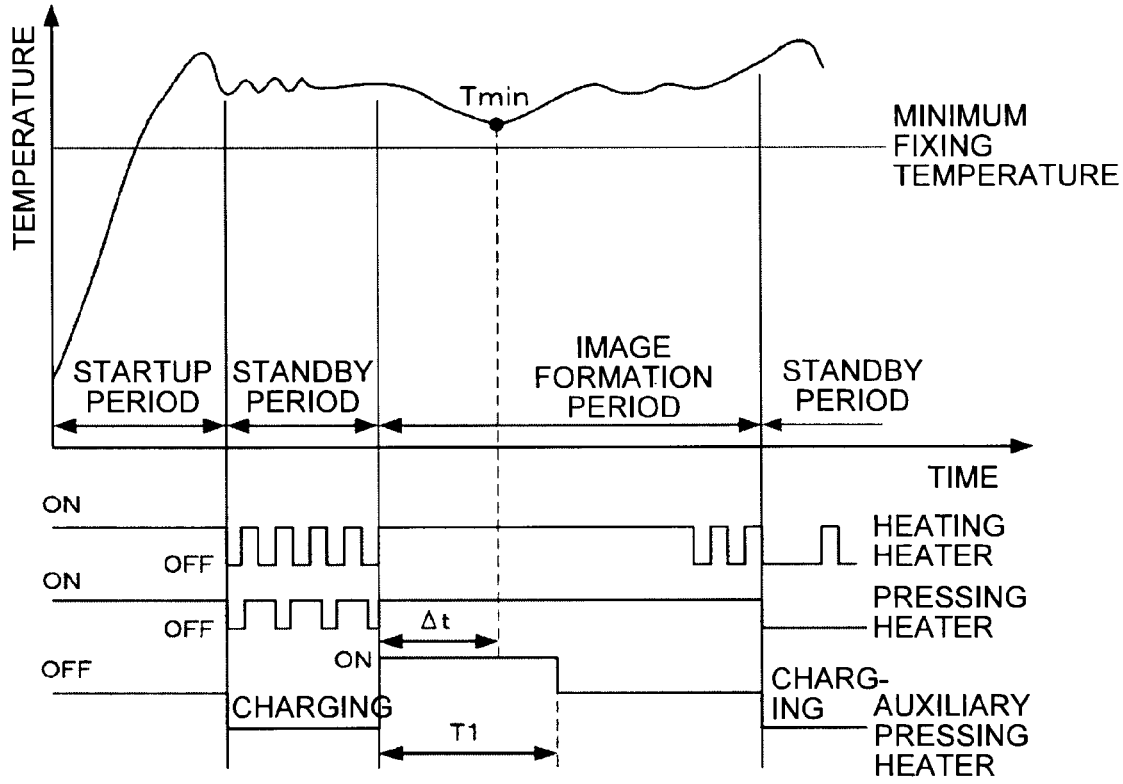
FIG. 6 is a graph illustrating timings to operate the pressing auxiliary heater.

Therefore, as illustrated in FIG. 6, the control unit 91 functioning as a supplementary heater controller controls to heat the pressing roller 69 using the halogen heater 73*a* for a period T1, including Δt, that is from first operational timing when image formation is started, that is when the transfer sheet S is started to be passed through the fixing nip 70, to second operational timing that is $T_{min}$ at which the temperature of the fixing belt 63 becomes the lowest after the image formation is started.

Because the capacitor 81 supplies the power to the halogen heater 73*a*, a discharge from the capacitor 81 to the halogen heater 73*a* is performed by the control unit 91 functioning as the auxiliary heating control unit for the powering period T1 that is longer than the period Δt from the time at which the image formation is started. In this manner, as illustrated in FIG. 6, the temperature of the fixing belt 63 is prevented from dropping below the minimum fixing temperature even at $T_{min}$. The amount of and the time of discharge from the capacitor 81 are set so that the temperature of the fixing belt 63 is prevented from dropping below the minimum fixing temperature. Because the capacitor 81 is used as an auxiliary power supply and is charged during a standby period, as illustrated in FIG. 6, even if the energy required in keeping the fixing belt 63 to the optimal temperature is relatively high, the sufficient energy can be provided during the image formation immediately after the system startup, without exceeding the rated power of the image forming apparatus 100.

The ratio between the output of the halogen heater 73*a* and the output of the halogen heater 78 is set to a ratio between the heat capacity of the cylindrical portion 73*b* and the heat capacity of the pressing roller 69. In other words, when the heater watts of the halogen heater 73*a* is Q1, the heater watts the halogen heater 78 is Q2, the heat capacity of the cylindrical portion 73 is C1, and the heat capacity of the pressing roller 69 is C2, the relationship Q1:Q2=C1:C2 is satisfied. In this embodiment, because C1>C2, Q1>Q2 is established.

These settings are used because, to keep the temperature distribution in the sectional direction, that is, in the thickness direction, by heating the pressing roller 69 internally and externally, it is desirable to set the output of the halogen heater 73*a* and the output of the halogen heater 78 to a ratio that is almost proportional to the ratio between the heat capacities of the heater roller 73 and the pressing roller 69.

Such a structure of and operations performed by the fixing unit 6 prevent the temperature of the fixing belt 63 from dropping below the minimum fixing temperature (the lower limit of the fixing temperature), and prevents the fixing quality or fixing property from deteriorating even immediately after the system startup, as illustrated in FIG. 6 while the transfer sheet S is passed through the fixing nip 70, even if several to several tens of transfer sheets S are continuously passed. Even when a color image is to be formed, the temperature of the fixing belt 63 is prevented or suppressed from dropping while the leading edge through the trailing edge of the transfer sheet S is passed through the fixing nip 70, and a variation in the luster or gloss of the fixed image can be prevented or suppressed.

In this manner, by using the halogen heater 73*a* in the fixing unit 6, the surface temperature of the fixing belt 63 is prevented or suppressed from dropping even immediately after the system startup, the surface temperature is kept at temperature suitable for fixing, and high quality fixing is performed, for example, an appropriate luster is achieved.

When the halogen heater 73*a* is used, the temperature of the pressing roller 69, and the temperature of the fixing belt 63 in turn, tend to increase compared with when the halogen heater 73*a* is not used. Such a tendency of a temperature increase could become prominent on the area where the paper is not passed when the fixing is performed to a small-sized transfer sheet S. However, because the heat pipe roller 77 equalizes the temperature of the pressing roller 69 in the longitudinal direction of the fixing belt 63, excessive heating of the pressing roller 69 and the fixing belt 63 is prevented or suppressed.

An exemplary embodiment of the present invention is explained above. However, the present invention is not limited to the specific embodiment, and various modifications and changes are still possible within the scope of the present invention as described in the appended claims, unless specified otherwise in the descriptions above.

Figure 7:
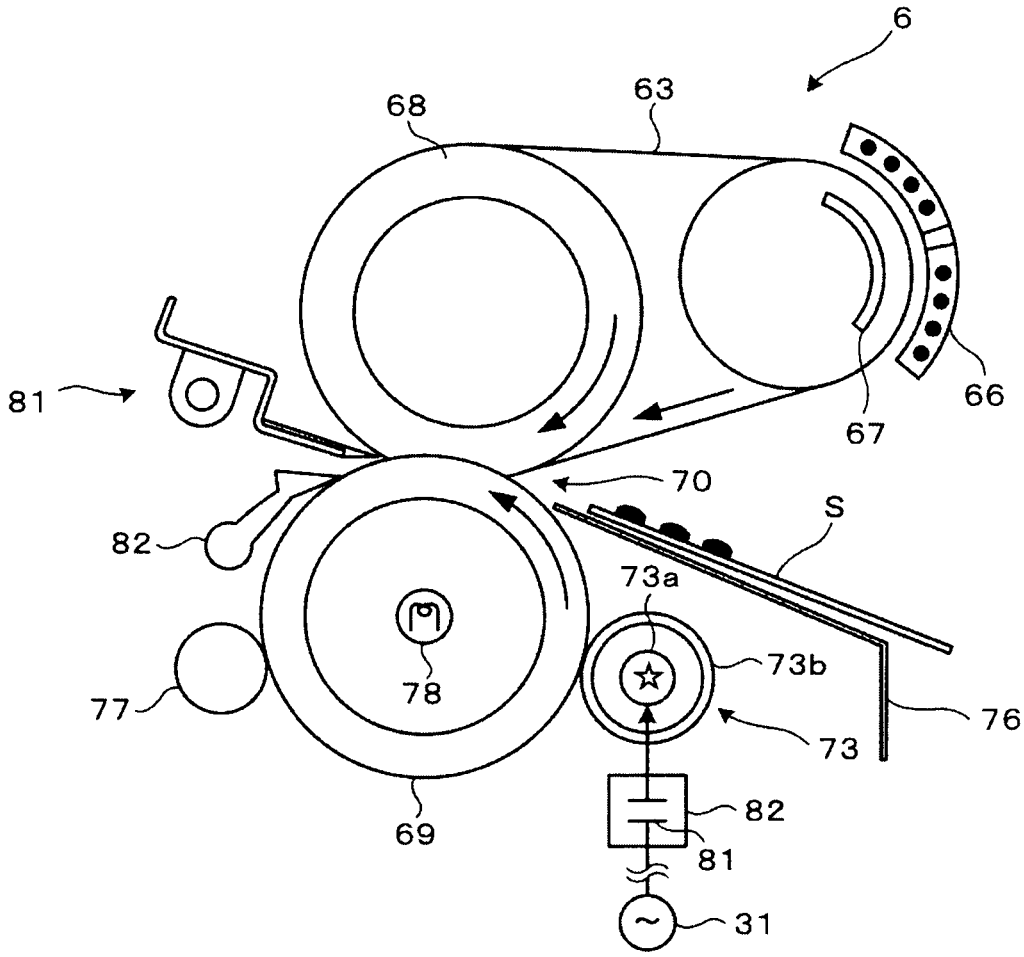
FIG. 7 is a general front view of another example of a fixing unit included in the image forming apparatus illustrated in FIG. 1.

For example, the fixing heater may be an induction heater (IH) 66 adopting induction heating by which the fixing belt 63 is directly heated by electromagnetic induction, instead of the halogen heater 65. In FIG. 7, the reference numeral 67 indicates a magnetic flux shielding member for preventing the electromagnetic field generated by the IH 66 toward the fixing belt 63 from affecting other members.

Furthermore, fixing rotatable body is not limited to a member in the shape of endless belt like the fixing belt 63, and may also be a fixing roller having a roller shape. The pressing rotatable body is not limited to a roller-like member like the pressing roller 69, and may be a pressing belt in the shape of an endless belt.

An image forming apparatus to which the present invention is applied may be a tandem type image forming apparatus adopting a direct transfer, instead of the indirect transfer explained above. Furthermore, the image forming apparatus may be applied in the same manner to a so-called single drum image forming apparatus in which the toner image in each of the colors is sequentially formed on a single photosensitive drum in a manner superimposed over one another to achieve a color image, as well as the so-called tandem type image forming apparatus. Furthermore, the present invention may also be applied in the same manner to an image forming apparatus in which the toner image in each of the colors is developed onto an image carrier such as a sheet-like organic photosensitive element but the colors are superimposed over one another using a separate intermediate transfer body, or to an image forming apparatus using a plurality of intermediate transfer bodies or using an intermediate color toner.

Although many recent image forming apparatuses are now color apparatuses such as a color copying machine and a color printer because of market demands, the image forming apparatus may be an apparatus that can form only a monochromatic image.

When developer is used as an image forming material used in the image forming apparatus, the developer is not limited to two-component developer, and may also be a single-component developer. Furthermore, the image forming material may be ink, as long as such a material needs to be fixed.

The image forming apparatus may be each of the copying machine, the printer, and the facsimile, instead of an MFP, and may also be an MFP having a different combination, such as an MFP of a copying machine and a printer.

According to the present invention, because the pressing rotatable body is heated from the surface side, the pressing rotatable body is suppressed from absorbing the heat from the fixing rotatable body and a sudden temperature drop in the fixing rotatable body is prevented even immediately after the system startup. Furthermore, because the fixing rotatable body is kept at temperature suitable for fixing, deterioration of the fixing quality can be avoided. A fixing unit contributing to high-quality image formation can be thus provided.

The power can be used effectively in raising the temperature of the heating rotatable body without exceeding the rated power. Furthermore, because the temperature is raised by heating the pressing rotatable body from the surface side, the pressing rotatable body can be suppressed from absorbing the heat from the fixing rotatable body and a sudden temperature drop in the fixing rotatable body is prevented even immediately after the system startup. Furthermore, the fixing rotatable body can be maintained at temperature suitable for fixing, and deterioration in the fixing quality can be avoided. A fixing unit contributing to high-quality image formation can be thus provided.

Because the pressing rotatable body is heated from inside and outside to keep the temperature distribution in the thickness direction of the pressing rotatable body uniform, the pressing rotatable body can be prevented from absorbing the heat from the fixing rotatable body and a sudden temperature drop in the fixing rotatable body is prevented even immediately after the system startup. Furthermore, the fixing rotatable body can be maintained at temperature suitable for fixing, and deterioration in the fixing quality can be avoided. A fixing unit contributing to high-quality image formation can be thus provided.

Because the pressing rotatable body is heated from the surface side so that a decrease in the surface temperature of the fixing rotatable body is minimized and the fixing rotatable body is maintained at temperature suitable for fixing, the pressing rotatable body can be prevented from absorbing the heat from the fixing rotatable body and a sudden temperature drop in the fixing rotatable body is prevented even immediately after the system startup. Furthermore, the fixing rotatable body can be maintained at temperature suitable for fixing, and deterioration in the fixing quality can be avoided. A fixing unit contributing to high-quality image formation can be thus provided.

Because the temperature unevenness of the pressing rotatable body is alleviated quickly at a position downstream of a position where the pressing rotatable body abuts against the fixing rotatable body in the rotating direction of the pressing rotatable body, a so-called offset of the image forming material can be prevented or suppressed. Furthermore, because the pressing rotatable body is heated from the surface side, the pressing rotatable body can be prevented from absorbing the heat from the fixing rotatable body and a sudden temperature drop in the fixing rotatable body is prevented even immediately after the system startup. Furthermore, the fixing rotatable body can be maintained at temperature suitable for fixing, and deterioration in the fixing quality can be avoided. A fixing unit contributing to higher-quality image formation can be thus provided.

Because the crosslinking agent is used, as well as quick alleviation of the temperature unevenness of the pressing rotatable body at a position downstream of a position where the pressing rotatable body abuts against the fixing rotatable body in the rotating direction of the pressing rotatable body, the so-called offset of the image forming material can be further prevented or suppressed. Because the pressing rotatable body is heated from the surface side, the pressing rotatable body can be prevented from absorbing the heat from the fixing rotatable body and a sudden temperature drop in the fixing rotatable body is prevented even immediately after the system startup. Furthermore, the fixing rotatable body can be maintained at temperature suitable for fixing, and deterioration in the fixing quality can be avoided. A fixing unit contributing to higher-quality image formation can be thus provided.

According to the present invention, the pressing rotatable body can be prevented from absorbing the heat from the fixing rotatable body and a sudden temperature drop in the fixing rotatable body can be prevented even immediately after the system startup. Furthermore, the fixing rotatable body is maintained at temperature suitable for fixing, and deterioration in the fixing quality can be avoided. An image forming apparatus that can perform high-quality image formation can be thus provided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A fixing unit comprising:

a fixing rotatable body that is located at a side of a recording medium, the side carrying a not-fixed image;

a pressing rotatable body that is located at another side of the recording medium and that is disposed so as to abut on the fixing rotatable body;

a fixing heating unit that heats the fixing rotatable body;

a first pressing heating unit that heats the pressing rotatable body from inside of the pressing rotatable body; and a second pressing heating unit that is disposed opposite to a surface of the pressing rotatable body and that heats the pressing rotatable body from outside of the pressing rotatable body, wherein a ratio between an output of the first pressing heating unit and an output of the second pressing heating unit is set to be equal to a ratio between a heat capacity of the pressing rotatable body and a heat capacity of the second pressing heating unit.

2. The fixing unit according to claim 1, further comprising an auxiliary power supply that includes a capacitor to supply a power to the second pressing heating unit.

3. The fixing unit according to claim 1, further comprising a heat pipe that is disposed so as to abut on the pressing rotatable body, at a downstream side, in a rotational direction of the pressing rotatable body, of a position where the pressing rotatable body abuts on the fixing rotatable body, and at a upstream side, in a rotational direction of the pressing rotatable body, of a position where the second pressing heating unit abuts on the pressing rotatable body.

4. The fixing unit according to claim 3, wherein a surface of the heat pipe is coated with a cross-linking agent to raise a softening point of an image forming material by reacting with the image forming material.

5. A fixing unit comprising:

a fixing rotatable body that is located at a side of a recording medium, the side carrying a not-fixed image;

a pressing rotatable body that is located at another side of the recording medium and that is disposed so as to abut on the fixing rotatable body;

a fixing heating unit that heats the fixing rotatable body;

a first pressing heating unit that heats the pressing rotatable body from inside of the pressing rotatable body; and a second pressing heating unit that is disposed opposite to a surface of the pressing rotatable body and that heats the pressing rotatable body from outside of the pressing rotatable body, wherein the second pressing heating unit heats the pressing rotatable body during a time period from a first timing when the recording medium starts to pass between the fixing rotatable body and the pressing rotatable body to a second timing when a temperature of the fixing rotatable body becomes the lowest after the first timing.

6. An image forming device comprising the fixing unit of claim 5.

7. The fixing unit according to claim 5, further comprising an auxiliary power supply that includes a capacitor to supply a power to the second pressing heating unit.

8. The fixing unit according to claim 5, further comprising a heat pipe that is disposed so as to abut on the pressing rotatable body, at a downstream side, in a rotational direction of the pressing rotatable body, of a position where the pressing rotatable body abuts on the fixing rotatable body, and at a upstream side, in a rotational direction of the pressing rotatable body, of a position where the second pressing heating unit abuts on the pressing rotatable body.

9. The fixing unit according to claim 8, wherein a surface of the heat pipe is coated with a cross-linking agent to raise a softening point of an image forming material by reacting with the image forming material.

10. An image forming apparatus comprising a fixing unit, the fixing unit including:

a fixing rotatable body that is located at a side of a recording medium, the side carrying a not-fixed image;

a pressing rotatable body that is located at another side of the recording medium and that is disposed so as to abut on the fixing rotatable body;

a fixing heating unit that heats the fixing rotatable body;

a first pressing heating unit that heats the pressing rotatable body from inside of the pressing rotatable body; and a second pressing heating unit that is disposed opposite to a surface of the pressing rotatable body and that heats the pressing rotatable body from outside of the pressing rotatable body, wherein a ratio between an output of the first pressing heating unit and an output of the second pressing heating unit is set to be equal to a ratio between a heat capacity of the pressing rotatable body and a heat capacity of the second pressing heating unit.

* * * * *